United States Patent [19]

Kun-Ming

[11] 4,106,914

[45] Aug. 15, 1978

[54] SAFETY FUEL GAS AND APPARATUS FOR GENERATING THE SAME

[76] Inventor: Liu Kun-Ming, No. 52, Lane 63, Lung Kang Rd., Section 1,, Chung Li, Taiwan

[21] Appl. No.: 795,346

[22] Filed: May 9, 1977

[51] Int. Cl.[2] ..... C10G 9/24

[52] U.S. Cl. ..... 48/103; 48/107; 62/52; 73/293; 116/118 R; 123/122 E; 222/3; 261/26; 261/30; 261/119 R; 261/142; 261/DIG. 65; 431/210; 431/213; 126/44; 196/121

[58] Field of Search ..... 48/107, 103; 261/26, 261/30, 119 R, 121 M, 142, DIG. 65; 431/210, 213; 196/120, 121; 126/38, 43, 44; 123/122 E, 34 A; 62/52; 222/3; 73/293; 116/118 R

[56] References Cited

U.S. PATENT DOCUMENTS

| | | | |
|---|---|---|---|
| 523,675 | 7/1894 | Morris | 431/210 |
| 682,211 | 9/1901 | Ludwig | 48/107 |
| 835,627 | 11/1906 | Loring | 431/210 |
| 2,043,647 | 6/1936 | Berven | 261/119 R |
| 2,123,884 | 7/1938 | Faverty | 48/107 |
| 2,501,496 | 3/1950 | Cartwright | 261/142 |
| 2,739,608 | 3/1956 | Brower | 261/26 |
| 3,341,450 | 9/1967 | Ciabattari et al. | 261/119 R |

FOREIGN PATENT DOCUMENTS

| | | | |
|---|---|---|---|
| 1,398,953 | 6/1975 | United Kingdom | 48/107 |

*Primary Examiner*—S. Leon Bashore
*Assistant Examiner*—George C. Yeung
*Attorney, Agent, or Firm*—Ladas, Parry, Von Gehr, et al

[57] ABSTRACT

Liquid fuel comprising hydrocarbon as its main component, which is in liquid state at normal temperature and pressure, is held in a container of an apparatus for vaporization of the liquid fuel to enable the fuel to be readily converted into a gaseous state for example for cooking purpose.

1 Claim, 3 Drawing Figures

SAFETY FUEL GAS AND APPARATUS FOR GENERATING THE SAME

BACKGROUND OF THE INVENTION

This invention relates to fuel gas, in particular fuel gas for cooking purpose, and an apparatus for generating the same.

Fuel conventionally used in cookers, such as town gas, natural gas and LPG (liquefied petroleum gas) etc. has good ignition characteristics and provides complete combustion. On the other hand, it can cause suffocation or toxic effects and has an explosive inflammability. Thus, any carelessness in using or in handling, e.g. in storage or transportation, of the conventional fuel gas may cause accidents such as toxication, explosion and fire. However liquid fuel gives rise to ignition problems due to its higher flash point and also may be subject to incomplete combustion due to its incomplete vaporization, thus causing poor combustion efficiency and pollution of the air.

BRIEF SUMMARY OF THE INVENTION

It is therefore an object of this invention to provide a safety fuel gas which eliminates the above-mentioned problems while remaining the inherent merits of conventional fuel gas.

It is a further object of this invention to provide an apparatus for generating safety fuel gas from a fuel which is in liquid state at normal temperature and pressure.

In accordance with the principle of this invention, liquid fuel comprising hydrocarbon as its main component, which is in liquid state at normal temperature and pressure, is held in a container and apparatus for vaporizing this liquid fuel is provided so that the liquid fuel is enabled to be readily converted into a gaseous state for example for cooking purpose.

In one preferred embodiment, the liquid for producing fuel gas of this invention is composed of 80 - 85% n-hexane, 10 - 15% petroleum ether and 5 - 10% rubber solvent. This liquid so formulated may be vaporized under a pressure of about 0.48 kg/cm$^2$ at room temperature, and the gas vaporized from this liquid includes very little amount of sulfur so that no sulfur dioxde or carbon monoxide is produced during combustion, this contributes to a complete combustion. Since the fuel is normally in liquid state, it renders a high degree of safety, ease and convenience in handling or using it. Since the liquid fuel is converted into gas for use, complete combustion of it may be realized. Therefore, the fuel gas generated in accordance with this invention possesses all merits of both conventional gas fuel and liquid fuel, while eliminating their disadvantages, and is harmless to human.

As one aspect of this invention, an apparatus for vaporizing liquid fuel is provided, which comprises a sliding vane type rotary air compressor having a rotor and an electric motor coupled to drive the rotor, an inlet pipe connected to a compressed air outlet passageway of the air compressor for introducing the compressed air into a container for the liquid fuel, an outlet pipe connected to the container permitting the vaporized liquid fuel to leave the container and a pressure detector responsive to the pressure within the container to control the motor, the detector including a flexible disc member positioned against the pressure, a switch controlling the energization of the motor and a projection provided on the flexible disc member for coupling movement of the flexible disc member to the switch whereby the pressure detector switches the motor to maintain the pressure in the container substantially constant.

The container for the liquid is made capable of withstanding an internal pressure of at least 0.5 kg/cm$^2$ which is required for vaporization of the liquid fuel contained therein. Preferably, the container is made of plastic material such as high density polyethylene, and an electric light is provided in a recess formed in the bottom of the container for heating and for making the liquid level inside the container visible from outside through the wall of the container.

Provision of this apparatus thus enables the liquid fuel to the readily converted into a gaseous state for use.

BRIEF DESCRIPTION OF THE DRAWING

This invention will clearly appear from the following description of a preferred embodiment with reference to the accompanying drawings, in which.

DETAILED DESCRIPTION OF THE PREFERRED EMBODIMENT OF THE INVENTION

Figure 1:
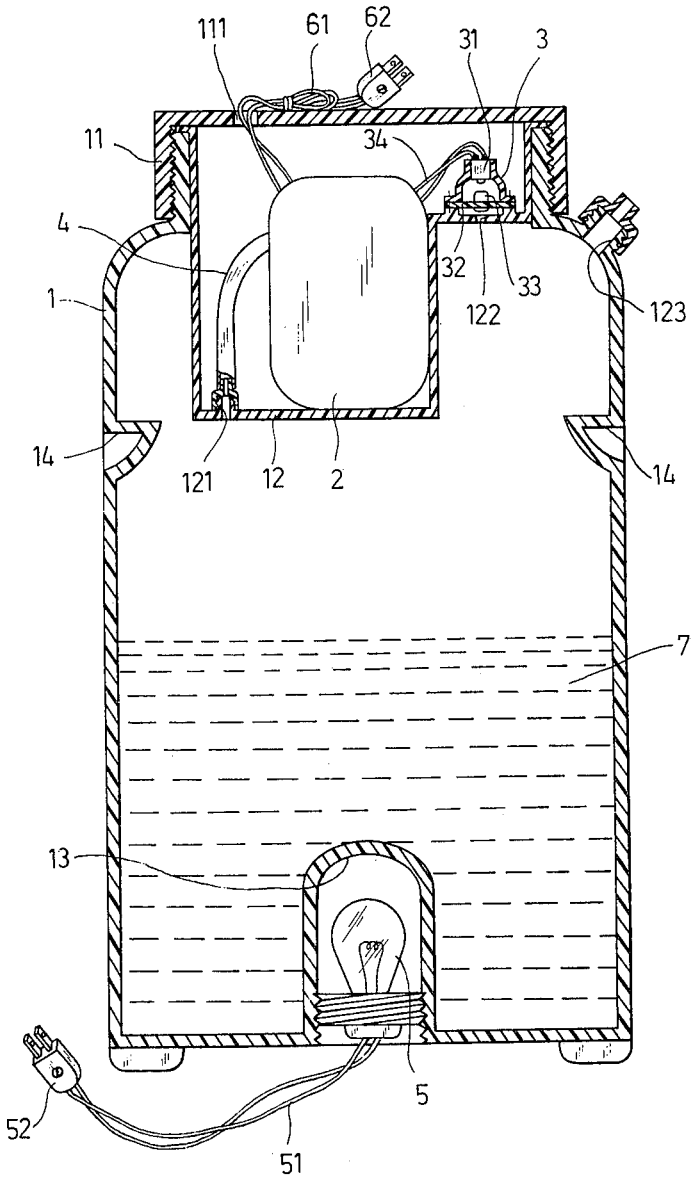
FIG. 1 is a schematic view illustrating an embodiment of this invention, with certain parts in cross section.

Referring to the drawing, reference numeral 1 depicts a container for liquid, which has an opening closed with a removable cover 11. A partition member 12 of substantially cylindrical shape is closely fitted in the opening of the container 1 so that the opening of the container is airtightly closed and a chamber is defined by the partition member 12 and the cover 11 when the latter is set in position, in which chamber an air compressor 2 and a pressure detector 3 are located.

Figure 3:
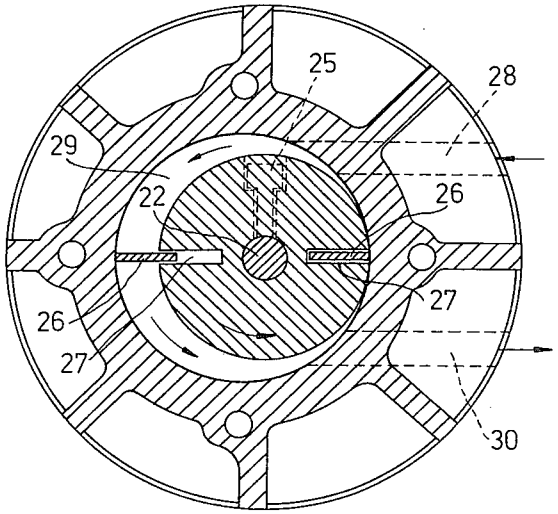
FIG. 3 is a cross sectional view taken along the line III—III in FIG. 2.
Figure 2:
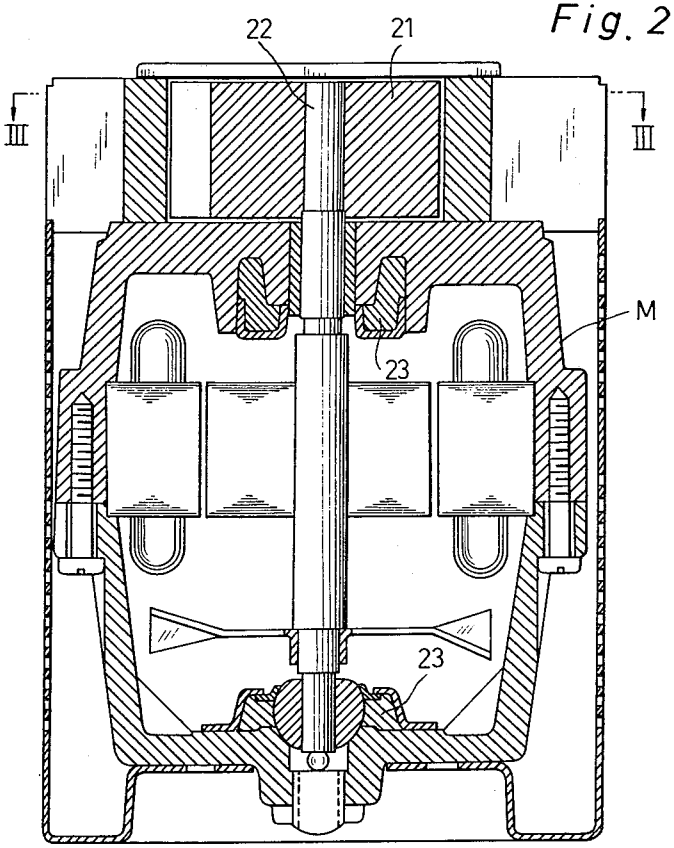
FIG. 2 is a vertical section through a sliding vane type rotary air compressor in the apparatus shown in FIG. 1.

The air compressor 2 is of small size and, as shown in FIG. 2, has an A.C. electric motor M having an output shaft 22 mounted in oil-less bearings 23 providing smooth running. The shaft 22 extends upwardly from the motor proper and carries a rotor 21 which, as shown in FIG. 3, is secured to the shaft 22 by a thread pin or bolt 25. The rotor 21 has two diametrically opposed sliding vanes 26 located in respective slots 27. As can be seen the vanes cooperate with the circular wall of the chamber 29 in which the rotor 21 is located, the chamber axis being offset from that of the shaft axis. Two parallel passageways 28 and 30 extend into the same side of the chamber 29. The passageway 28 serves to admit air into the chamber, where the air is then compressed by the rotation of the rotor 21, in an anti-clockwise direction as indicated by the arrows, after which the compressed air leaves the chamber through the passageway 30. The motor of the air compressor 2 is energized via electric cord 61 and plug 62 shown in FIG. 1. The compressed air outlet passageway 30 of the air compressor 2 is connected to an inlet port 121 via a pipe 4 for introducing the compressed air into the inside of the container wherein liquid fuel 7 is held. For normal operation of the air compressor, the cover 11 of the container 1 is provided with an opening 111 for ventilation.

As shown in FIG. 1, the above-mentioned pressure detector 3 includes a flexible disc member 32 positioned against the pressure in the container via a hole 122 in the partition member 12, a projection 33 carried by the disc member 32 on the side opposite the hole 122, and a switch 31 mounted in face of the projection 33 with a predetermined distance between the operation button of the switch 31 and the projection 33. The switch 31 is coupled to the motor circuit via electric cords 34 so that the switch 31 may be switched to control the on-off of the air compressor. Since the disc member 32 is made of flexible material, it will develop an upward movement to force the projection 33 carried therewith to operate the switch 31 as the pressure in the container reaches a predetermined level.

To permit vaporized liquid fuel to leave the container for example for cooking purpose, the container 1 is provided with an outlet port 123 which may be connected to a gas consuming cooker via a pipe not shown. Two recesses 14 are formed in the side wall of the container, by means of which the container may be handled and moved easily. Furthermore, a recess 13 is formed in the bottom wall of the container, and an electric light 5 energized via electric cords 51 and plug 52 is mounted in the recess 13. The light from the electric light 5 may cause the liquid level to be visible from outside the container so that the existing amount of liquid fuel is readily apparent. The electric light 5 also produces heat which facilitates vaporization of the liquid fuel.

Although the operation of the apparatus of this invention may be apparent from the above description, it is still summarized as follows. When in use, the outlet port 123 is connected to a gas consuming cooker via a pipe not shown, the electric light 5 is turned on to check the liquid level. The air compressor 2 is then energized into operation and compressed air produced by the air compressor passes into the liquid gas container 1 through the inlet port 121 via the pipe 4. The liquid fuel 7 is thus vaporized by the heat content of the compressed air. The vaporized fuel passes out of the container through the outlet port 123. As the pressure in the container comes up to a predetermined level, the flexible disc member 32 moves upward and causes the projection 33 to switch the electric switch 31, thus deenergizing the motor M of the air compressor 2. As the pressure in the container drops the consequent downward movement of the flexible disc member 32 and the projection 33 resets the electric switch 31 thus restarting the motor M to increase the pressure. Thus the pressure in the container 2 is automatically maintained at a predetermined average value, preferably 0.48 kg/cm$^2$, required for the vaporization of the liquid fuel.

As mentioned above, the liquid 7 may be a mixture of 80 - 85% n-hexane, 10 - 15% petroleum ether and 5 - 10% rubber solvent.

What is claimed is:

1. Apparatus for generating safety fuel gas comprising a container holding a fuel which is in a liquid state at normal temperature and pressure, said container is made of a light transmissible material and said container is of sufficient strength to withstand an internal pressure of at least 0.5 kg/cm$^2$, a sliding vane type rotary air compressor having a rotor and an electric motor coupled to drive the rotor, an inlet pipe connected to a compressed air outlet passageway of the air compressor for introducing the compressed air into the container to vaporize the liquid fuel, an outlet port provided on the container permitting the vaporized liquid fuel to leave the container and a pressure detector responsive to the pressure within the container to control the motor, the detector including a flexible disc member positioned to respond to the pressure, a switch controlling the energization of the motor and a projection provided on the flexible disc member for coupling movement of the flexible disc member to the switch whereby the pressure detector switches the motor to maintain the pressure in the container substantially constant wherein the bottom of the container defines a recess and an electric light bulb is housed in said recess to provide a visual indication of fuel level and to provide heat to facilitate vaporization of fuel in said container.

* * * * *